US005367605A

United States Patent [19]

Violi

[11] Patent Number: 5,367,605

[45] Date of Patent: Nov. 22, 1994

[54] BOILER WITH DEFORMABLE WALL FOR REMOVING SCALE

[75] Inventor: Raymond Violi, Marlens, France

[73] Assignee: Societe Cooperative de Production Bourgeois, Faverges, France

[21] Appl. No.: 895,274

[22] Filed: Jun. 8, 1992

[30] Foreign Application Priority Data

Jun. 10, 1991 [FR] France ..... 91 07264

[51] Int. Cl.[5] ..... F24H 1/20; F28G 5/00; F22B 1/28

[52] U.S. Cl. ..... 392/401; 122/379; 122/494; 126/361; 165/84; 392/443; 392/451; 392/458

[58] Field of Search ..... 392/400, 443, 449, 451, 392/461, 462, 458, 401; 122/13.1, 13.3, 494, 379, 4; 126/361, 363, 362; 165/84; 68/15

[56] References Cited

U.S. PATENT DOCUMENTS

| | | | |
|---|---|---|---|
| 1,143,291 | 6/1915 | Lovekin | 122/494 |
| 1,840,834 | 1/1932 | Davis | 134/17 X |
| 1,984,791 | 12/1934 | Finken | 165/84 |
| 2,360,590 | 10/1944 | Schweller | 219/549 X |
| 2,582,250 | 1/1952 | Herschberg | 165/84 X |
| 2,602,644 | 7/1952 | Sandstrom | 165/84 |
| 2,655,803 | 10/1953 | Richardson | 68/15 |
| 2,793,988 | 5/1957 | Latham et al. | 165/84 X |
| 3,178,913 | 4/1965 | Olson | 68/15 X |
| 4,032,748 | 6/1977 | Vischer et al. . | |
| 4,256,576 | 3/1981 | Blickle et al. | 165/84 X |

FOREIGN PATENT DOCUMENTS

| | | | |
|---|---|---|---|
| 606028 | 11/1934 | Germany . | |
| 1932061 | 1/1970 | Germany | 122/494 |
| 1915337 | 10/1970 | Germany | 165/84 |
| 2611851 | 3/1976 | Germany . | |
| 57-58025 | 4/1982 | Japan | 392/443 |
| 3108 | of 1884 | United Kingdom | 126/361 |
| 2131135 | 6/1984 | United Kingdom | 392/449 |
| 8809595 | 12/1988 | WIPO . | |

*Primary Examiner*—Anthony Bartis
*Attorney, Agent, or Firm*—Ratner & Prestia

[57] ABSTRACT

A boiler for the production of steam and/or hot water has a principal enclosure limited by a watertight wall for containing water, a bottom water extraction outlet,a water supply inlet, an upper steam outlet and a level detector controlling the water level in the enclosure. Electric immersion heating elements are provided in the enclosure for heating the water to generate steam. At least one section of the enclosure wall adjacent the water level on which scale deposits are likely to form is deformable by flexion and is stressed by time-varying deformations of the wall produced by variations of water and/or steam pressure in the enclosure which causes the film of scale deposited on the inner surface of the at least one deformable section to break up and become detached so that they fall to the bottom of the enclosure for easy elimination by drainage of the water from the enclosure through the bottom water extraction outlet.

6 Claims, 7 Drawing Sheets

BOILER WITH DEFORMABLE WALL FOR REMOVING SCALE

BACKGROUND OF THE INVENTION

1. Field of the Invention

The present invention relates to boilers for the production of hot water or steam.

2. Description of the Prior Art

Known boilers consist of a principal enclosure limited by a watertight wall for containing water, water supply piping means to introduce the water into the principal enclosure through at least one water inlet, and water extraction piping means to extract the water and/or the steam from the principal enclosure through at least one outlet. Electric resistor means, connectable to an external source of electric energy, are disposed inside the enclosure or in its walls in order to heat the water contained in the principal enclosure.

When such known boilers are used, the mineral elements dissolved in the water tend to be deposited on the walls of the boiler, forming a film of scale. This film progressively constitutes a thermally insulating wall between the water to be heated and the heating electric resistor means, thereby causing untimely overheating of the resistors and reducing the amount of hot water or steam produced for the same consumption of electricity.

To overcome these drawbacks, it is necessary to clean the boiler periodically, e.g. by introducing a sufficient quantity of dilute acid, for example vinegar, in order to dissolve the film of scale. Other methods consist in treating the water before it is introduced into the boiler.

However, all these known methods incur running costs which are by no means negligible and require constant supervision to ensure timely intervention.

In practice, cleaning operations are not carried out with sufficient regularity, and are dependent on the care shown by the user with regard to the maintenance of the boiler.

Boiler structures, such as those described in document DE-A-2 611 851 or document U.S. Pat. No. 4,032,748, are also known. In these structures the deposits of scale on the heating element are broken up through the effect of the variable thermal expansion of the heating element wall. The efficiency of these structures proves insufficient.

Piping and heat exchange structures between two liquids have been known for a long time, through document DE-C-606 028. In these structures the heat exchange wall separating the two liquids allows two positions of equilibrium. The passage from one position of equilibrium to another is brought about by applying a pressure to the outer liquid. Although this solution has been known for a long time, it has not been applied to boilers, and indeed it is not directly applicable.

SUMMARY OF THE INVENTION

The aim of the present invention is to reduce appreciably, and perhaps to eliminate altogether, the operations required to remove the scale which forms in a hot water or steam boiler.

Scale elimination should preferably be entirely automatic, and should require neither action nor supervision on the part of the user.

In order to achieve these objectives as well as others, the boiler according to the invention comprises the principal means of a known boiler structure, with a principal enclosure, water supply pipes and water and/or steam evacuation pipes, and electric resistor means for heating the water contained in the principal enclosure. According to the invention:

the wall of the principal enclosure comprises at least one section which is deformable by flexion, said deformable section is stressed by mechanical thrust means which produce time-varying deformations by flexion.

These successive deformations of the wall result in the film of scale which is formed on the deformable section of the enclosure wall being broken up into particles, said particles becoming detached from the wall and gathering in the bottom of the enclosure from where they may be eliminated easily at a later date by draining the water contained in the enclosure.

Naturally, it is preferable that the section which is deformable by flexion should be that section of the enclosure wall on which scale deposit is likely to form most quickly.

The successive, time-varying, deformations by flexion may be produced by variations in water and/or steam pressure in the enclosure, or by mechanical control means supplied by an external source of energy.

According to a first embodiment, the outer wall of the principal enclosure is itself deformable by flexion and receives immersion heater elements which serve to heat the water. The deformations of the enclosure wall allow scale forming on said wall to be detached. Cleaning the enclosure then involves only partial cleaning of the immersion heater elements. Cleaning may be carried out by removing the immersion heater elements from the enclosure and by immersing them in a receptacle of smaller volume containing the appropriate acid solution.

According to another embodiment, the section of the enclosure wall which is deformable by flexion is itself a heating element, for example containing within its thickness buried electric resistor elements which are connected to an external source of electric energy. The scale then tends to prefer forming on the heating walls which, through their successive deformations, cause the particles of scale to become detached. These particles may then be eliminated easily.

BRIEF DESCRIPTION OF THE DRAWINGS

Further objects, characteristics and advantages of the present invention will be apparent from the following description of particular embodiments, reference being made to the accompanying drawings in which.

DESCRIPTION OF THE PREFERRED EMBODIMENTS

Figure 1:
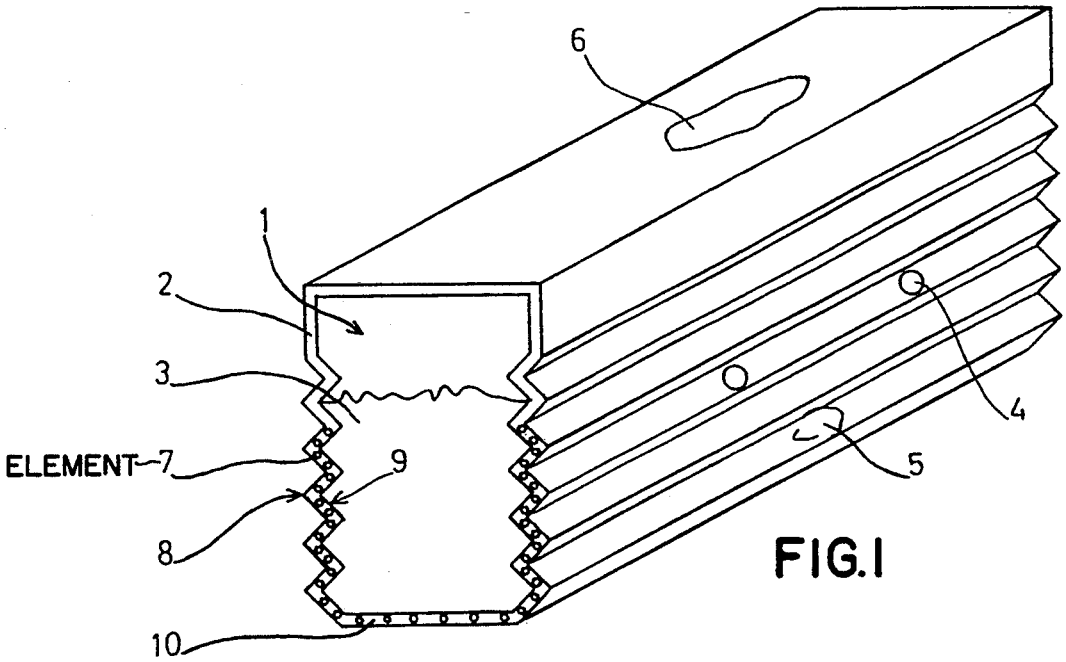
FIG. 1 represents in diagram form and in perspective a principal enclosure structure of a boiler according to the present invention.

In all the embodiments shown in the figures, and particularly in the embodiment shown in FIG. 1, a boiler according to the invention for the production of hot water or steam comprises a principal enclosure 1 limited by a watertight wall 2 for containing water 3. Water supply piping means allow the water to be introduced into the principal enclosure 1 through at least one water inlet 4. Water extraction piping means take the water out of the enclosure through a water outlet 5 and allow it to be extracted from the principal enclosure. The water outlet 5 is usually located in the lower part of the enclosure 1, said principal enclosure 1 also being equipped with an upper steam outlet 6. Electric resistor means 7, connectable to an external source of electric energy (not represented), are disposed to heat the water 3 contained in the principal enclosure 1.

The wall 2 of the principal enclosure comprises at least one section 8 which is deformable by flexion. This deformable section 8 is stressed by thrust means producing time-varying deformations by flexion. Several types of thrust means may be used, and these will be described hereinafter.

The successive deformations of the deformable section 8 of the wall allow the breaking up into fine particles of the film of scale which may form on the inner side 9 of the deformable section 8 of the wall. The scale particles thus obtained fall to the bottom 10 of the principal enclosure, and are then drained out through the outlet 5.

Figure 2:
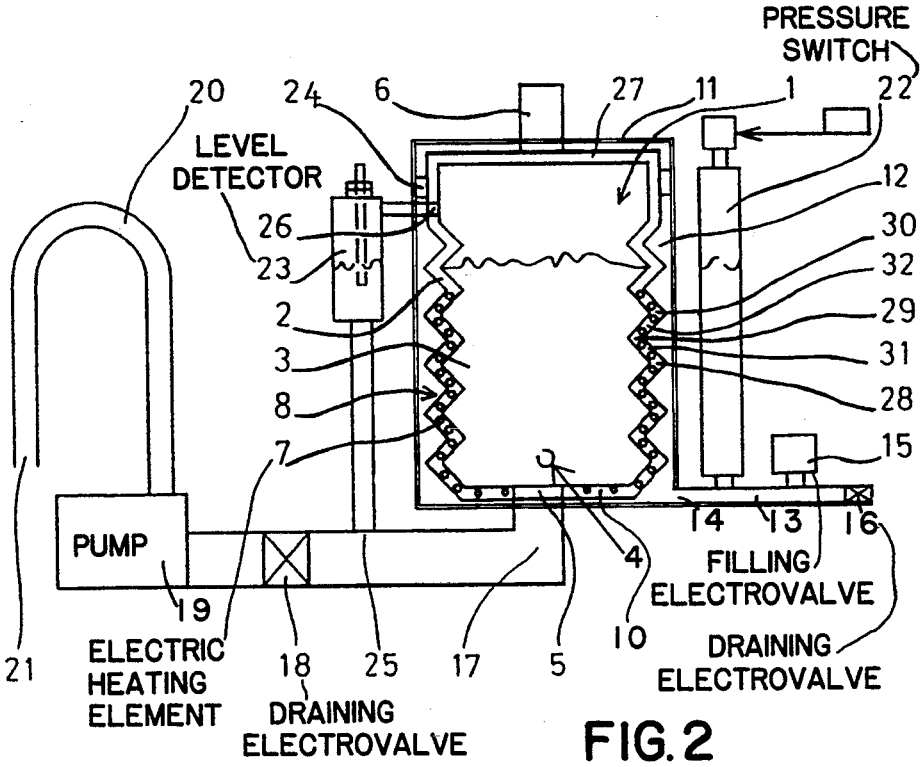
FIG. 2 represents in diagram form the principal elements of a boiler structure according to the present invention, allowing the production of pressurized steam.

FIG. 2 represents a principal enclosure 1, similar to that represented in FIG. 1, inserted in an outer enclosure 11. The principal enclosure 1 is thus housed inside the wall of the outer enclosure 11, said wall of outer enclosure 11 being rigid. In the represented embodiment, the outer enclosure 11 is equipped with means of water supply to and evacuation from the space 12 between the wall of the outer enclosure 11 and the wall of the principal enclosure 1. For example, the water passage pipe 13 communicates with the outer enclosure 11 through a lower orifice 14 at one end and, at its other end, it communicates with both a filling electrovalve 15, connected to an external source of water, and a draining electrovalve 16 which communicates with an evacuation pipe. When the filling electrovalve 15 is opened, water may be introduced into the space 12. This water pushes the deformable section 8 of the principal enclosure 1 upwards, reducing its volume, and causing flexion of the deformable section 8 of the wall of the principal enclosure 1. The filling electrovalve 15 is then closed and the draining electrovalve 16 is opened, so that the water contained in the space 12 is evacuated and the flexible section of the wall of the principal enclosure 1 returns to its original shape, as represented in FIG. 2. The external water contained in the space 12 thus serves to stress the wall of the principal enclosure 1 at will, so as to cause the deformation of its deformable section between a maximum-volume position and a minimum-volume position.

The outlet 5 communicates with a non-rigid principal draining pipe 17 which is itself equipped with a draining electrovalve 18, a pump 19 and a siphon 20, allowing the water 3 contained in the principal enclosure 1 to be evacuated to an evacuation orifice 21 leading to an evacuation pipe. Suction from the pump 19 allows rapid evacuation of the water 3 contained in the principal enclosure, and the flow of water carries away in an efficient manner the particles of scale previously deposited in the bottom 10 of the principal enclosure 1.

In the represented embodiment, a pressure sensitive switch 22 measures the pressure in the pipe 13 and in the space 12 of the outer enclosure 11. The pressure sensitive switch allows the measurement of the level of water contained in the outer enclosure 11. Similarly, a level detector 23 is provided in order to measure the water level in the principal enclosure 1. For example, the level detector 23 is a vertical tube whose upper end is connected to an upper measuring orifice 26 of the principal enclosure 1 and to a lower measuring orifice 25. The lower measuring orifice 25 may be located either in the lower section of the principal enclosure 1, or in the non-rigid principal draining pipe 17 upstream from the draining electrovalve 18, as represented in the figure.

The upper section of the principal enclosure 1 may be rigid and is held by spacers 24 in a fixed position in the outer enclosure 11. However, the lower section of the principal enclosure 1 is deformable by flexion.

In the embodiments which are represented in FIGS. 1 and 2, the principal enclosure 1 comprises a bottom 10 and an opposing wall 27 which are parallel to each other and linked to each other by a deformable peripheral wall 28. This deformable peripheral wall 28 includes alternate folding lines such as lines 29 and 30 parallel to the bottom 10 and to the opposing wall 27 and connecting facets, such as facets 31 and 32, which are inclined alternately inwards and outwards. In this way, through the action of mechanical stress, as for example during movements of the bottom 10 towards or away from the opposing wall 27, the peripheral wall 28 is deformed in concertina fashion. The non-rigid principal draining pipe 17 allows movements of the bottom 10 and of the peripheral wall 28 of the principal enclosure 1. The same holds true for the filling pipe, which must also be non-rigid, connected to the filling orifice 4.

In the embodiment represented in FIG. 2, the outer enclosure 11 makes it possible for the boiler to produce hot water, fluent steam, or even pressurized steam.

In addition, the peripheral wall 28 comprises electric resistors 7 buried within its thickness, and disposed in such a way as not to hinder the desired flexions of said peripheral wall. For example, the electric resistors 7 may comprise resistive conductors, parallel to the bottom 10 and to the opposing wall 27, distributed over the height of the peripheral deformable wall.

The flexion deformations of the peripheral wall 28 of the principal enclosure 1 are generated either in an intentional manner, by working the electrovalves 15 and 16, or at each filling or draining of the water 3 contained in the principal enclosure 1. In the latter case, an elastically deformable peripheral wall 28 may usefully be provided which is so constituted that it is in a folded position in the absence of water 3, with the bottom 10 being the closest to the opposing wall 27. When water 3 is introduced, the weight of the water deforms the peripheral wall 28 so as to move the bottom 10 away from the opposing wall 27, up to the unfolded position represented in FIG. 2. The elimination of the water 3 allows the principal enclosure 1 to fold, with the bottom 10 returning to a position close to the opposing wall 27. Successive water draining and filling thus makes it possible to evacuate the scale correctly.

Figure 3:
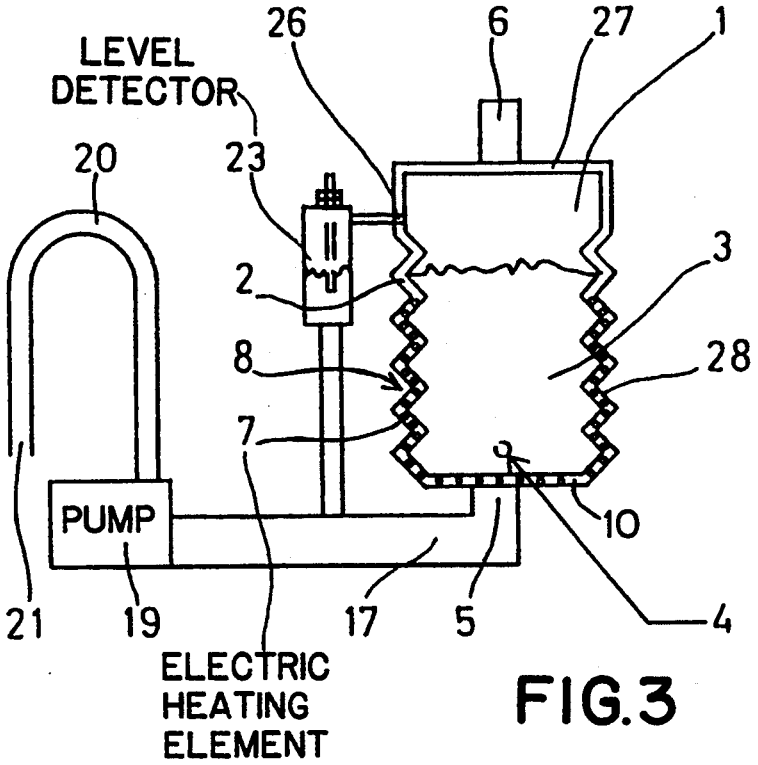
FIG. 3 represents the principal elements of a boiler structure according to the present invention, allowing the production of hot water or fluent steam.

In the embodiment represented in FIG. 3, the same principal elements are encountered as in the embodiment represented in FIG. 2, with the exception of the elements of the outer enclosure 11, of the pressure sensitive switch 22, and of the pipe 13 with the electrovalves 15 and 16. The draining electrovalve 18 may also be omitted. This structure is intended to work without pressure. This apart, the principal enclosure 1 possesses the same structure as that described in the embodiment represented in FIG. 2, with the same elements identified by the same numerical references. In this case, the peripheral wall 28 may be constituted of elastically deformable material so that the draining and filling of the water 3 cause the movements which are required to ensure the flexion deformations of the peripheral wall 28. Alternatively, the bottom 10 may be stressed by elastic means which push it upwards; the weight of the water 3 allows the bottom 10 to move downwards in opposition to the elastic means, and said weight of water deforms the peripheral wall 28.

Figure 4:
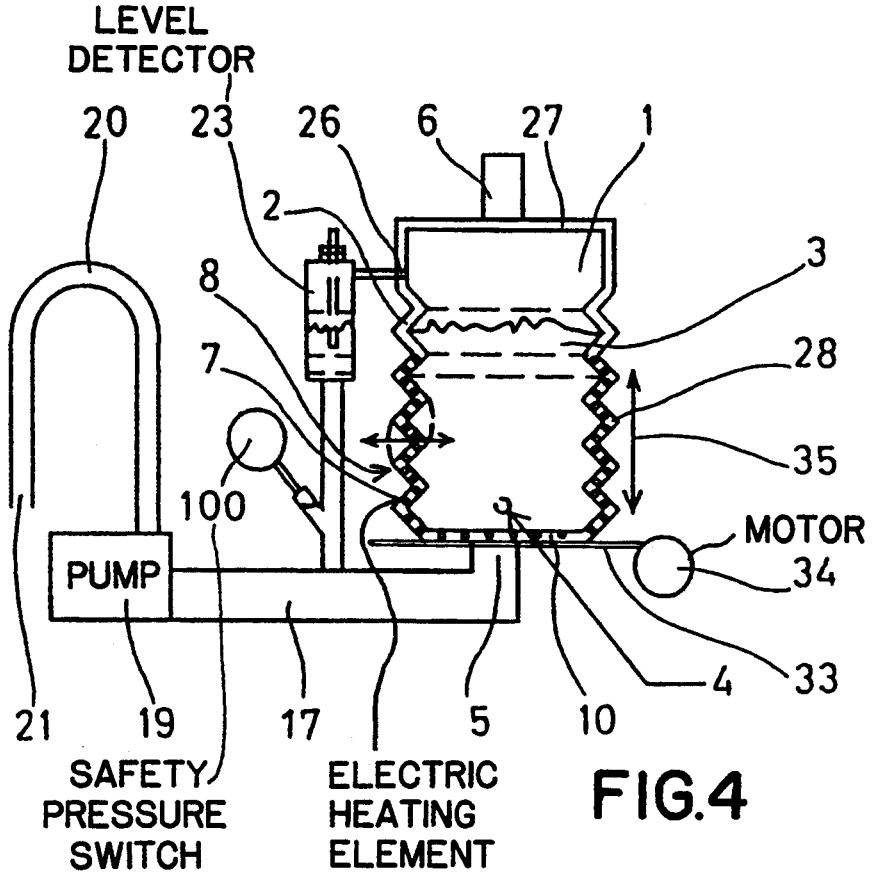
FIG. 4 represents another embodiment of a boiler according to the invention, for the production of hot water or fluent steam.

The embodiment represented in FIG. 4 is similar to that of FIG. 3. However, for more efficient control of the deformation movements of the peripheral wall 28, the bottom 10 is driven by a mechanical transmission 33 which is powered by a motor 34. The supplying of the motor 34 causes a bidirectional translation movement of the bottom 10, as indicated by the double arrow 35, between an unfolded position away from the opposing wall 27 and a folded position in which the bottom 10 is close to the opposing wall 27. By working the motor 34, it is thus possible to adapt the inner volume of the principal enclosure 1 and to deform the deformable section of the wall so as to break up the scale. In this embodiment, the electric resistor means 7 are also buried within the thickness of the peripheral wall 28. A safety pressure sensitive switch 100 measures the pressure produced by the water column in the principal enclosure 1, and produces a control signal when the pressure is at least equal to a predetermined value. The presence of the control signal permits power supply to the electric resistors 7. The absence of the control signal prohibits power supply to the electric resistors and causes water to be supplied up to the level which corresponds to said predetermined pressure value.

The ability to vary the volume of the principal enclosure 1 makes it possible to adapt at will the volume of water which is contained in the enclosure and which is necessary to cover the walls of the water heating means. A small volume of water reduces the temperature delay of the body of water, makes it possible to economize the energy required for steam production, and reduces the limescale deposits on the walls.

Figure 5:
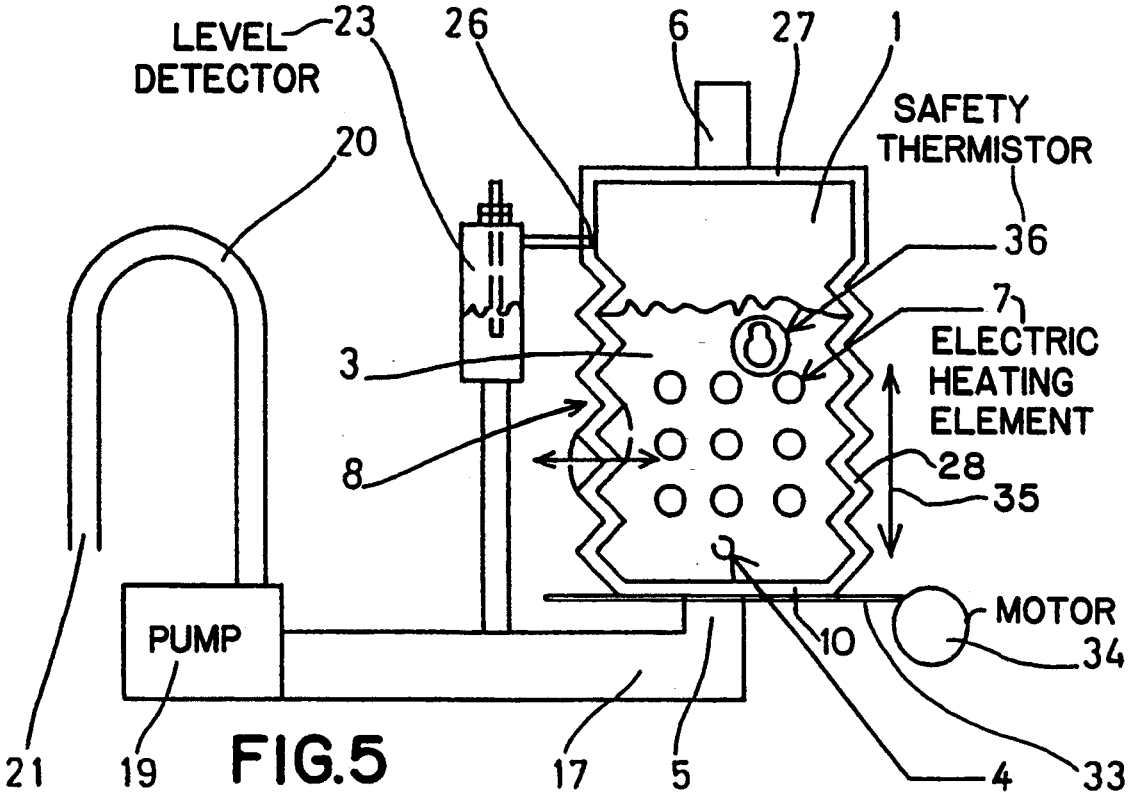
FIG. 5 represents another embodiment of a boiler according to the invention, for the production of hot water or fluent steam.

The embodiment represented in FIG. 5 is similar to that of FIG. 4, the difference being that, in this embodiment, the electric resistor means 7 are not buried within the peripheral wall 28, but are instead immersion heater elements housed in the lower section of the principal enclosure 1. The immersion heater elements 7 are horizontal bars which are fixed at each end to a transverse wall of the principal enclosure 1, and linked to an external source of electric energy by non-rigid electric connections. A safety thermistor 36 may also be disposed in the section of the principal enclosure 1 which is immediately above the immersion heater elements 7. The safety thermistor 36 itself comprises a heating resistor element as well as means for measuring its temperature. In the absence of water, the temperature of the safety thermistor 36 tends to exceed the permitted temperature, producing a signal detected by monitoring means which thus indicate the absence of water and may switch off the electric supply circuit of the immersion heater elements 7. Similarly, in the event of a degree of scaling which is above a permitted limit, the scale deposited on the safety thermistor 36 constitutes a thermal insulation of the thermistor, which itself tends to heat up more than usual. This overheating is detected and causes the electric supply of the boiler to be cut off. As in the embodiment represented in FIG. 4, the motor 34 makes it possible to move the bottom 10 between a folded position and an unfolded position, ensuring the deformation of the peripheral wall 28 so as to eliminate the scale which may be deposited on said wall. Cleaning of the immersion heater elements 7 must be carried out in the normal way.

In the preceding embodiments, in which the peripheral wall 28 is deformable in concertina fashion, the level of the water 3 contained in the enclosure 1 may also be measured or detected by assessing the force or pressure exerted by the bottom 10 on its means of support: in the case of an elastic peripheral wall 28, this force is assessed by the position of the bottom 10; in the case of a flexible, non-elastic peripheral wall 28, it is possible to measure the bearing force of the bottom 10 on its external support which is constituted, for example, by the transmission 33.

Figure 6:
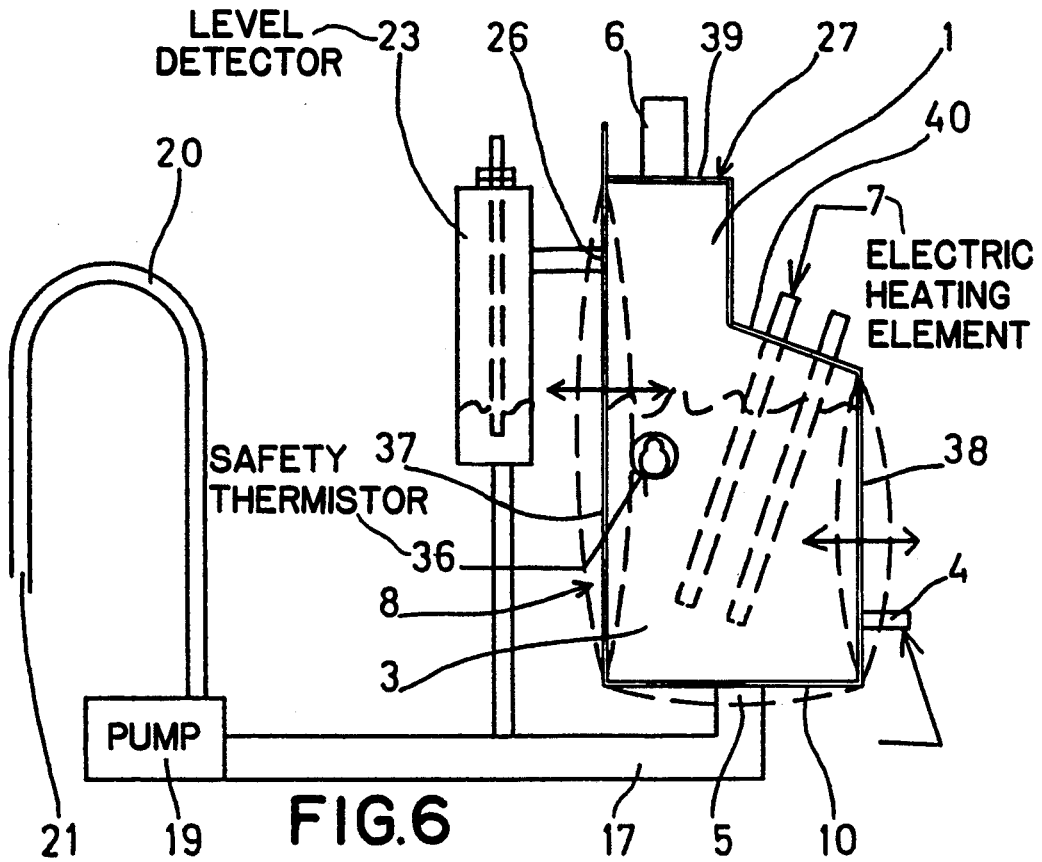
FIG. 6 represents an embodiment of a boiler according to the invention, with immersion heater and deformable side wall.

FIG. 6 represents an embodiment in which the shape of the principal enclosure 1 is slightly different. The bottom 10 is deformable, as represented by the dotted lines, with its edge being held at its periphery by a rigid frame. The deformable section 8 of the wall of the principal enclosure 1 comprises a first side wall 37 which is deformable by flexion, as represented by the dotted lines, and a second side wall 38 which is also deformable by flexion, as represented by the dotted lines. The opposing wall 27 comprises two zones at different heights: an upper zone 39 comprising the steam outlet 6, and a lower zone 40 comprising orifices for the passage of the immersion heater elements 7. The immersion heater elements are inserted obliquely into the principal enclosure 1 for ease of handling. A safety thermistor 36 is also placed in the principal enclosure 1. The filling orifice 4 and its non-rigid filling pipe are connected to the enclosure 1 in the deformable wall 38. The presence of water 3 in the principal enclosure 1 tends to push the deformable walls 37 and 38 outwards. When the water is drained by the drainage orifice 5, the deformable walls 37 and 38 return to their flat vertical positions, or may be sucked towards the inside of the enclosure 1 through the suction action of the pump 19.

Figure 7:
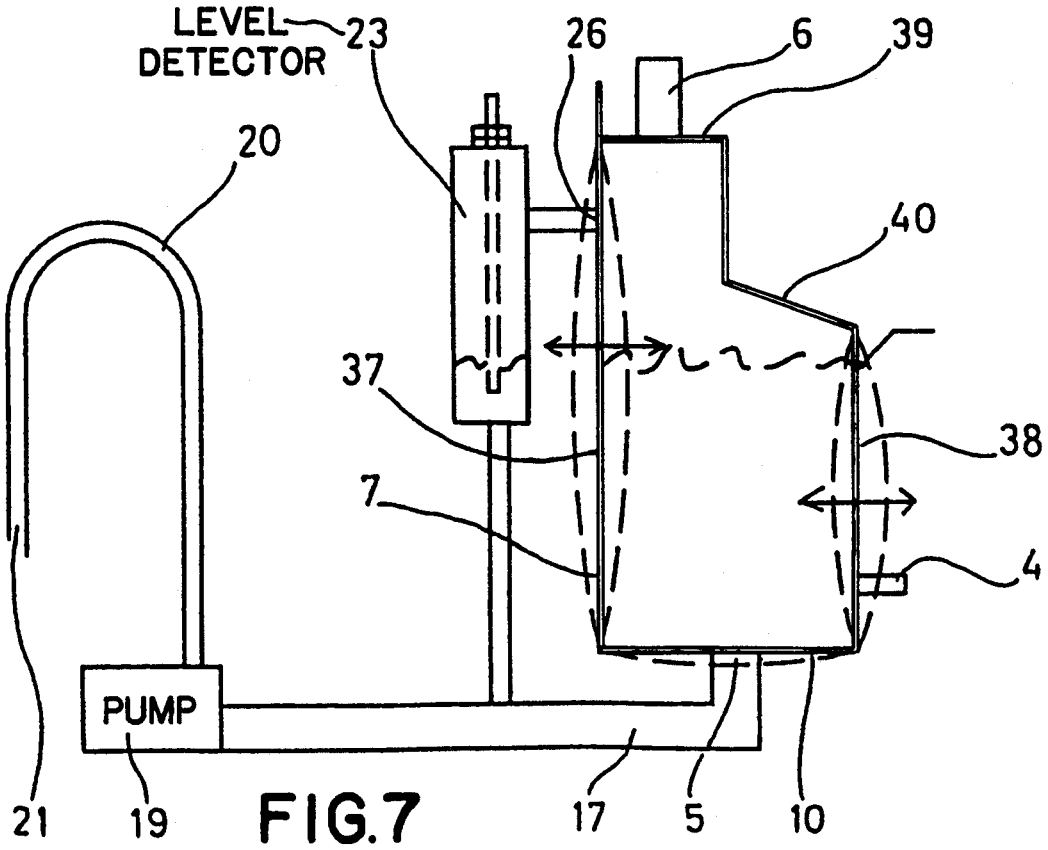
FIG. 7 represents another boiler structure according to the invention, with deformable and heating side wall.

The embodiment represented in FIG. 7 is similar to that of FIG. 6, with the difference that the enclosure does not contain an immersion heater 7, but the deformable walls 37 and 38 comprise electric resistor elements 7 buried in said walls and also in the bottom 10.

Figure 8:
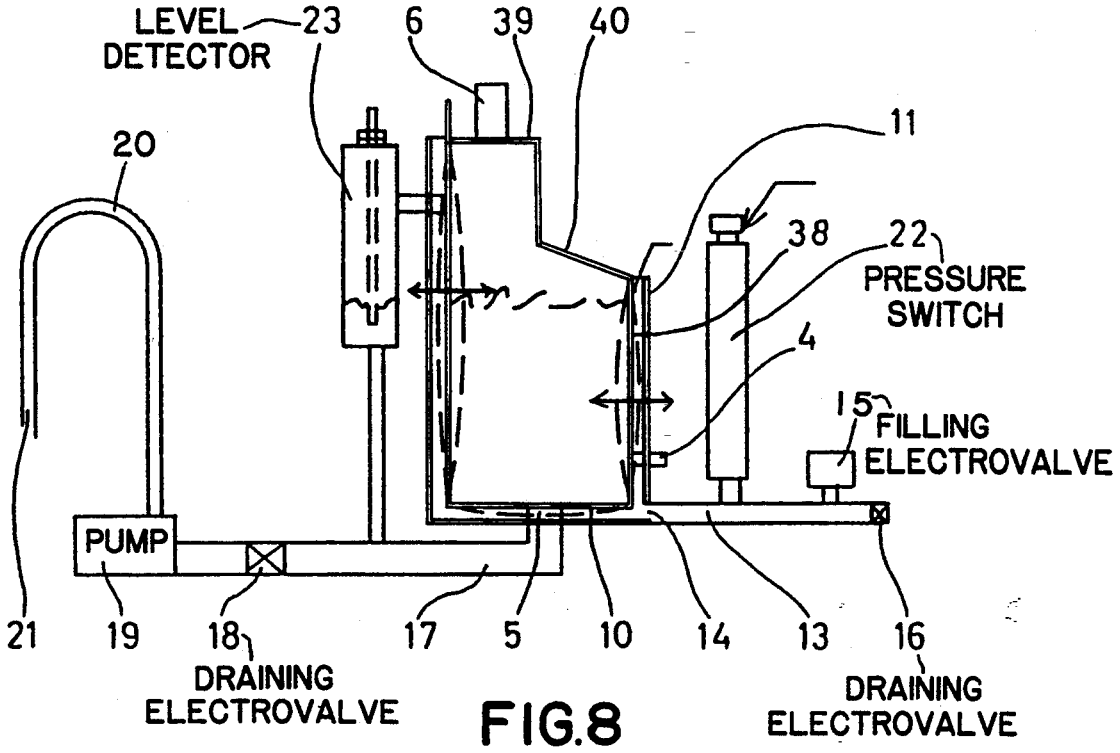
FIG. 8 represents a boiler structure according to an embodiment of the invention, with deformable and heating side wall for the production of pressurized steam.

The embodiment represented in FIG. 8 comprises the same elements as those in FIG. 7, and includes in addition an outer enclosure 11, a pressure sensitive switch 22, a pipe 13, an orifice 14, and filling and draining electrovalves 15 and 16 together with an electrovalve 18, as represented in the embodiment of FIG. 2. This embodiment allows the production of pressurized steam.

Figure 9:
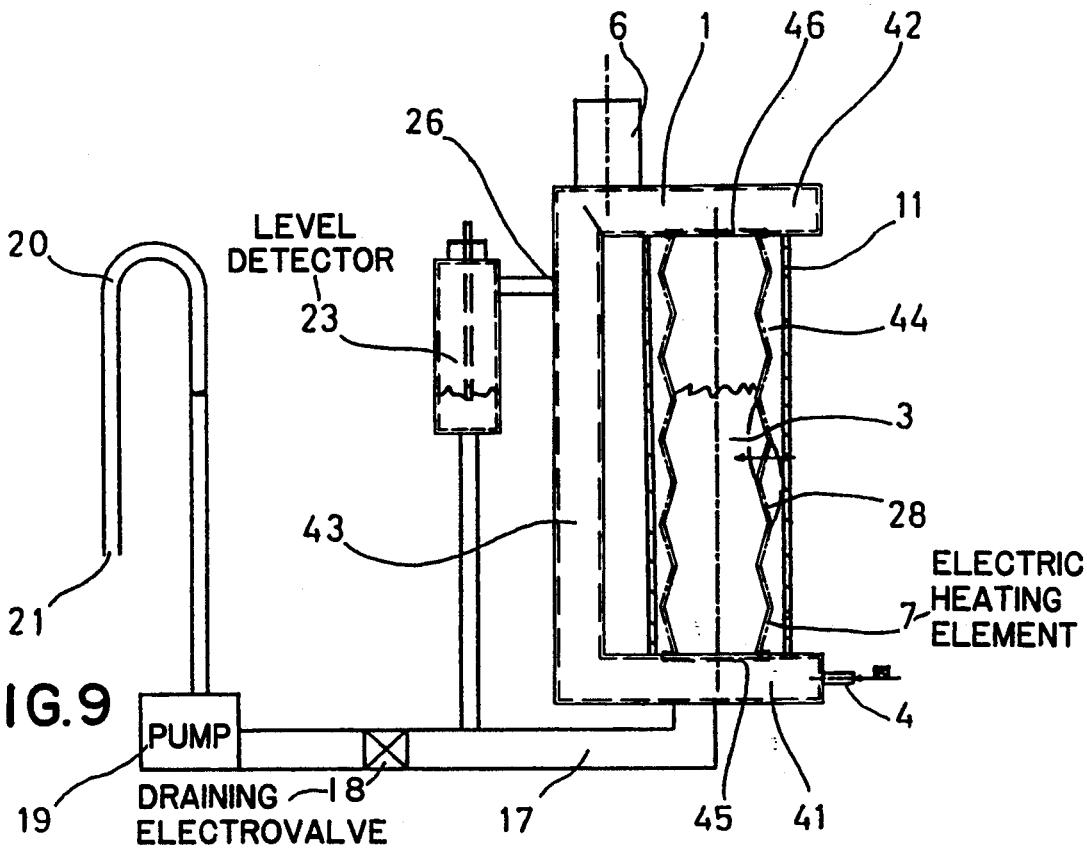
FIG. 9 represents another boiler structure according to the invention, comprising heating tubes for the production of pressurized steam.

FIG. 9 represents an embodiment in which the principal enclosure 1 comprises a rigid lower pipe 41, a rigid upper pipe 42, a return tube 43 connecting the lower and upper pipes 41 and 42, and one or several deformable heating pipes such as tube 44, each linking an upper orifice 45 of the lower pipe 41 and a lower orifice 46 of the upper pipe 42. The non-rigid deformable tube 44 is similarly constituted, with a deformable wall comprising electric resistor means buried within its thickness and distributed over its height to form heating elements. The deformable tube 44 is housed inside a rigid tube 11 which forms the outer enclosure.

Figure 10:
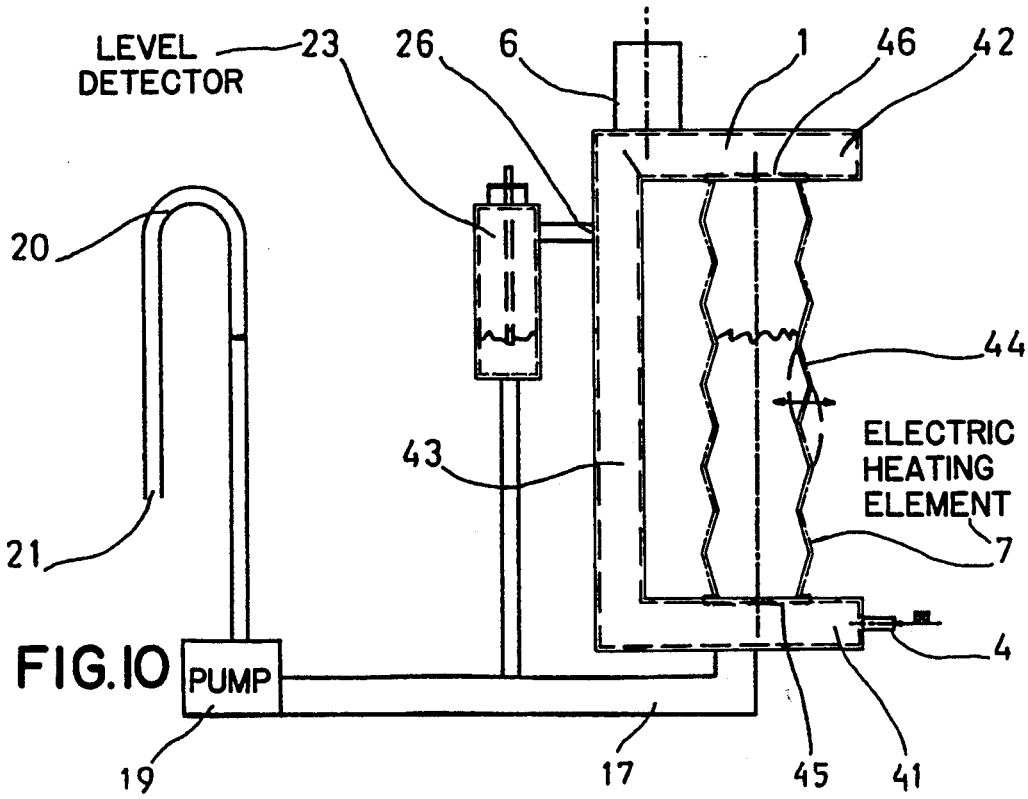
FIG. 10 represents a similar embodiment with heating tubes, for the production of fluent steam or hot water.

FIG. 10 illustrates an embodiment which is similar to that of FIG. 9, with the difference that the outer tube 11 and the draining electrovalve 18 are omitted. A boiler structure is thus created capable of producing hot water or fluent steam.

The embodiments represented in FIGS. 2, 3, 4 and 5 may be effected by means of a principal enclosure structure, of a general parallelepiped shape, such as that represented in FIG. 1.

Figure 11:
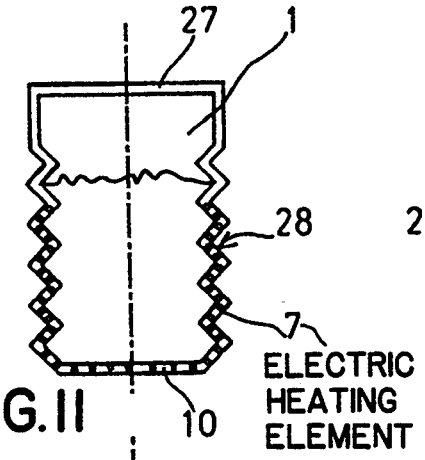
FIGS. 11 and 12 are longitudinal and cross sections of a heating enclosure with deformable wall according to the invention.
Figure 17:
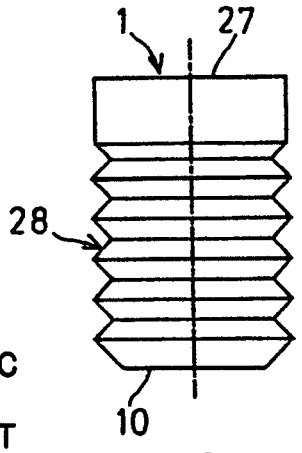
FIG. 17 is an external view of the heating enclosure shown in FIG. 11.
Figure 12:
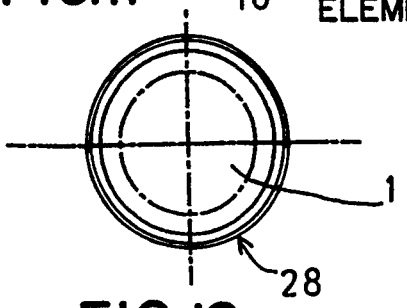

However, each of these embodiments may also be equipped with a principal enclosure 1 of a general cylindrical shape, as represented in FIGS. 11, 12 and 17. A principal enclosure so shaped comprises, in diagram form, a bottom 10, an opposing wall 27, and a peripheral wall 28 which is flexible in concertina fashion and in which the resistive conductors 7 are buried. FIG. 11 represents a longitudinal section of such a structure. FIG. 12 represents a top view of such a structure, showing a circular section. FIG. 17 also shows the circular shape, this time from a side view.

Figure 13:
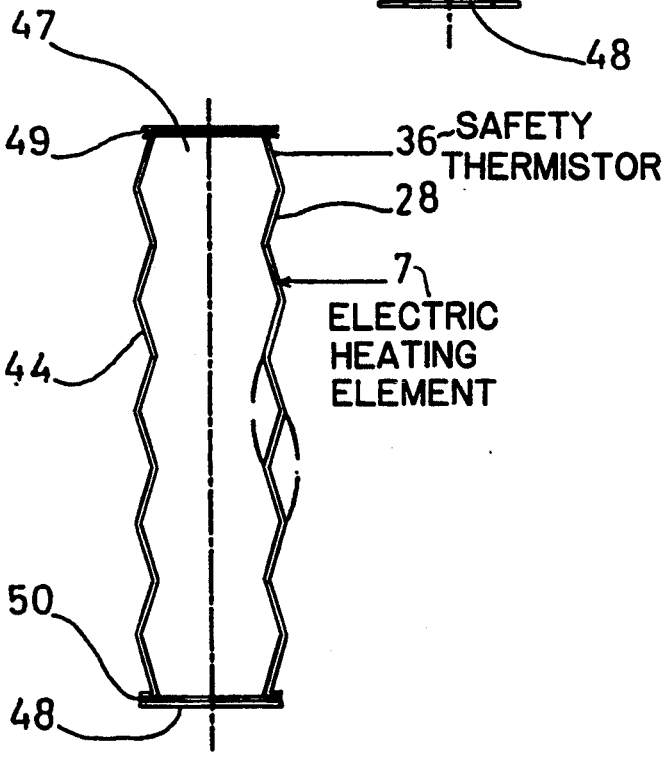
FIG. 13 is a longitudinal section of a heating tube with deformable wall according to the invention.

FIG. 13 illustrates the general structure of a flexible tube such as the tube 44 represented in the embodiment of FIG. 9 or 10. The deformable tube 44 is ended by an upper orifice 47 and a lower orifice 48 which are intended to fit respectively on orifice 46 and orifice 45 of the upper and lower pipes 42 and 41. A safety thermistor 36 is incorporated in the peripheral wall 28 of the tube 44 in the proximity of the upper orifice 47. The heating resistors 7 are buried in the wall of the tube, over its entire height. The circumferences of the upper orifice 47 and the lower orifice 48 have a double rim 49 and a peripheral ring groove 50 for tightness of the assembly, the groove being intended to receive the thickness of the corresponding wall of the edge of orifice 46 or 45 of the upper pipe 42 or the lower pipe 41 respectively when the deformable tube 44 is fitted onto the rigid structure formed by the return tube 43 and the lower and upper tubes 41 and 42.

Figure 14:
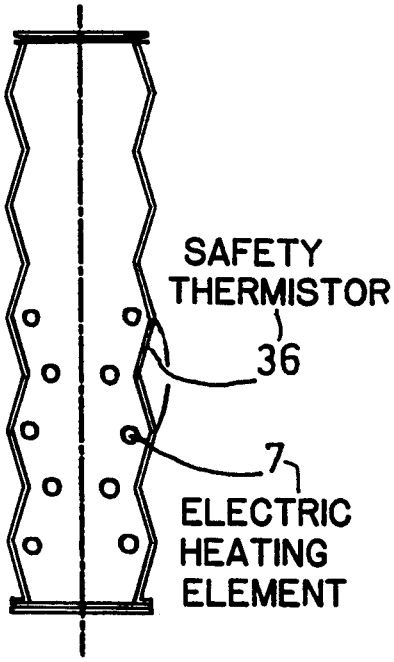
FIG. 14 is a longitudinal section of a heating tube in association with immersion heater resistor means.

FIG. 14 illustrates a similar embodiment to that of FIG. 13, but additionally comprising immersion heater elements 7 disposed inside the heating tube, in its lower half. The safety thermistor 36 is then placed slightly below the upper end of the zone occupied by the immersion heater elements 7.

In the embodiments of both FIGS. 13 and 14, the peripheral wall 28 of the heating tube is concertina shaped.

Figure 15:
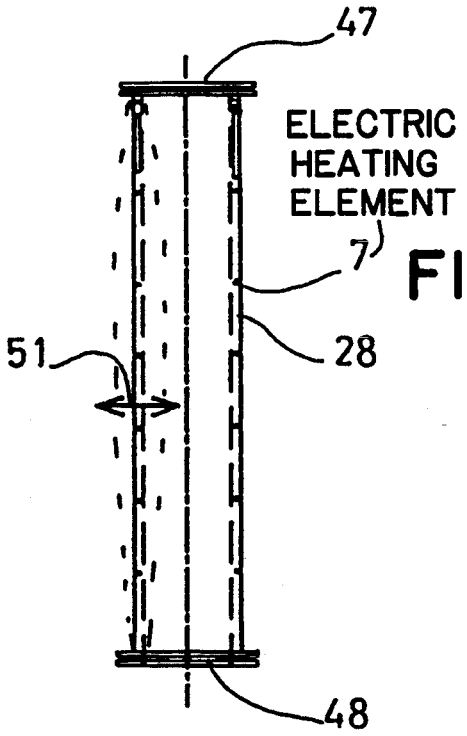
FIG. 15 is a longitudinal section of a smooth heating tube with heating wall according to the invention.

In the embodiment represented in FIG. 15, the heating tube also includes a peripheral deformable wall 28, but this wall does not possess concertina folds. Deformation then occurs as represented by the double arrow 51, and is sufficient to cause the elimination of scale on the inner face of the wall 28.

Figure 16:
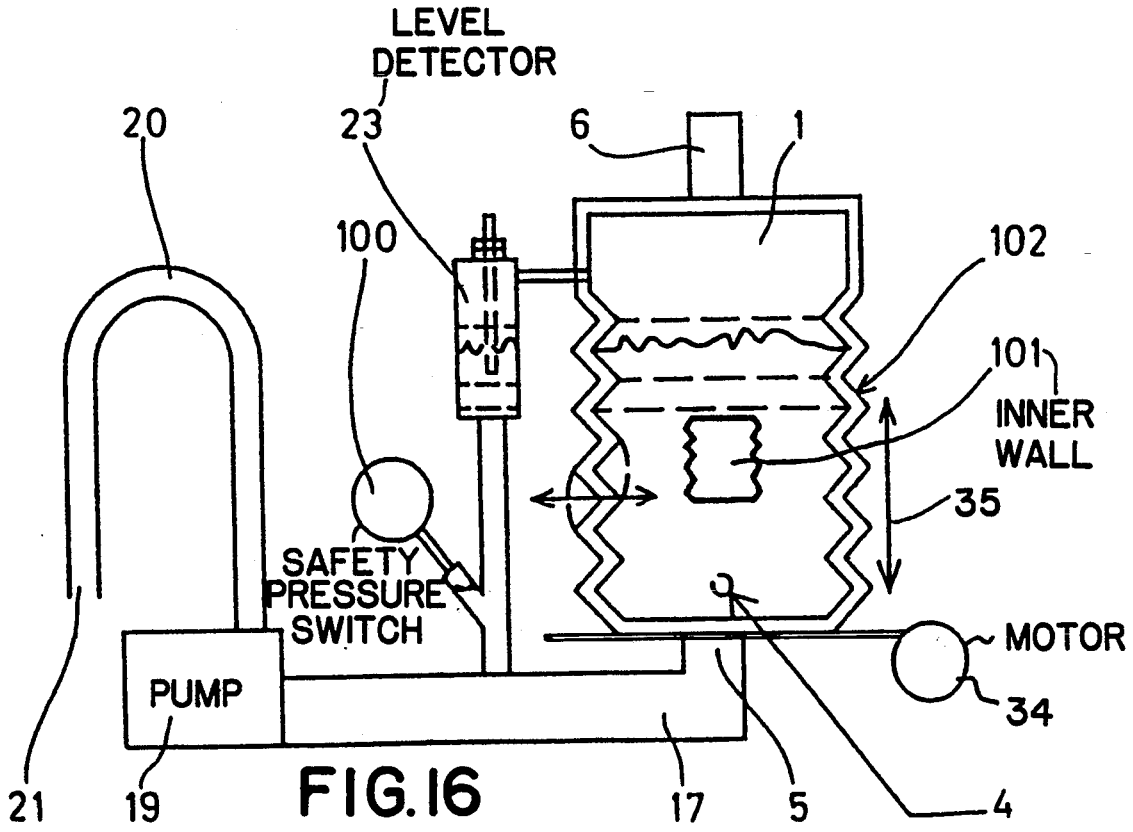
FIG. 16 represents a boiler according to the invention, equipped with a deformable immersion heating element.

According to another embodiment, represented by FIG. 16, the principal enclosure 1 is limited by an outer peripheral wall 102 and by an inner wall 101 which is inserted in the space demarcated by said outer peripheral wall 102. The inner wall 101 is deformable by flexion and constitutes the immersion heater element.

In all these embodiments, the deformable section 8 of the enclosure wall should preferably consist of a material of the group comprising:

a food grade polytetrafluoroethylene-impregnated glass fibre fabric,
the material known as "mylar",
polytetrafluoroethylene,
food grade EHT silicone rubber.

The present invention is not confined to the embodiments described above and includes the various variations and generalisations contained in the scope of the invention as defined in the appended claims.

I claim:

1. Boiler for the production of hot water or steam, comprising:

a principal enclosure limited by a watertight wall for containing water, said principal enclosure having a bottom, water supply piping means to introduce water into the principal enclosure through at least one water inlet, water extraction piping means to extract water from the principal enclosure through at least one outlet, said outlet disposed in the bottom of said principal enclosure, an upper steam outlet, a level detector for controlling the water level in the principal enclosure, electric resistor means, connectable to an external source of electric energy, and disposed to heat the water contained in the principal enclosure, wherein:

the wall of the principal enclosure comprises at least one section which is deformable by flexion, said deformable section being that section of the enclosure wall adjacent said water level on which scale deposit is likely to form most quickly, said deformable section being stressed by thrust means producing time-varying deformations by flexion, so that the successive deformations of the wall cause the film of scale deposited on the inside of the deformable section of the wall to break up, and cause the particles of scale thus obtained to become detached so that they fall to the bottom of the enclosure from where they may be easily eliminated by draining the water contained in the enclosure through the bottom outlet.

2. Boiler as claimed in claim 1, wherein variations of water and/or steam pressure in the enclosure produce said time-varying deformations by flexion.

3. Boiler as claimed in claim 1, wherein the principal enclosure is limited by a peripheral wall comprising said section which is deformable by flexion.

4. Boiler as claimed in claim 3, wherein said electric resistor means are immersion heater elements inserted in the principal enclosure.

5. Boiler as claimed in claim 1, wherein the deformable section of the enclosure wall is made from a material of the group comprising:

a food grade polytetrafluoroethylene-impregnated glass fibre fabric, the material known as "mylar", polytetrafluoroethylene, food grade EHT silicone rubber.

6. Boiler for the production of hot water or steam, comprising:

a principal enclosure limited by a watertight peripheral wall for containing water, water supply piping means to introduce water into the principal enclosure through at least one water inlet, water extraction piping means to extract water and/or steam from the principal enclosure through at least one outlet, an upper steam outlet, a level detector for controlling the water level in the principal enclosure, electric resistor means, connectable to an external source of electric energy, and disposed to heat the water contained in the principal enclosure, wherein:

the principal enclosure comprises a bottom and an opposing wall linked by the peripheral wall which is deformable by flexion, the bottom also being deformable by flexion and which is held to its periphery by a rigid frame, the peripheral wall of the principal enclosure comprises at least one section which is deformable by flexion, said at least one deformable section being that section of the enclosure wall adjacent said water level on which scale deposit is likely to form most quickly, said at least one deformable section being stressed by thrust means producing time-varying deformations by flexion, so that the successive deformations of the wall cause the film of scale deposited on the inside of the deformable section of the wall to break up, and cause the particles of scale thus obtained to become detached so that they fall to the bottom of the enclosure from where they my be easily eliminated by draining the water contained in the enclosure.

* * * * *